United States Patent [19]

Evans

[11] 4,151,705

[45] May 1, 1979

[54] COMBINATION RAM BIASED BOARD HOLD-DOWN AND EXHAUST INFEED

[75] Inventor: F. David Evans, Eugene, Oreg.

[73] Assignee: Kimwood Corporation, Cottage Grove, Oreg.

[21] Appl. No.: 841,941

[22] Filed: Oct. 13, 1977

[51] Int. Cl.[2] ..... B24B 21/08; B24B 55/06

[52] U.S. Cl. ..... 51/139; 51/273

[58] Field of Search ..... 51/135 R, 137, 138, 51/139, 273; 144/252

[56] References Cited

U.S. PATENT DOCUMENTS

| | | | |
|---|---|---|---|
| 1,978,149 | 10/1934 | Stevenson | 51/139 |
| 2,064,476 | 12/1936 | Johnson | 51/138 |
| 3,367,377 | 2/1968 | Mitten | 144/252 R |
| 3,782,044 | 1/1974 | Olin | 51/138 |
| 3,872,627 | 3/1975 | Schuster | 51/138 |
| 3,889,429 | 6/1975 | Zuercher | 51/135 R |

*Primary Examiner*—Nicholas P. Godici

*Attorney, Agent, or Firm*—Kolisch, Hartwell, Dickinson & Stuart

[57] ABSTRACT

Abrading apparatus including a frame, a workpiece support and an abrasive belt mounted above the support further includes an assembly combining a workpiece hold-down shoe and an entry duct movable with the shoe for exhausting debris during abrading action. The shoe extends transversely of the workpiece relative to its infeed direction of travel and also includes a member extending upwardly therefrom which forms a rear wall of the entry duct.

8 Claims, 5 Drawing Figures

COMBINATION RAM BIASED BOARD HOLD-DOWN AND EXHAUST INFEED

BACKGROUND AND SUMMARY OF THE INVENTION

The present invention relates to apparatus for abrading elongate workpieces such as lumber, and more particularly to an apparatus of the type utilizing a driven abrasive belt operable for planing the upper horizontal surface of a workpiece fed horizontally into contact with the belt.

Typical planing apparatus generally include one or more so-called hold down shoes which extend across a workpiece and urge it against a lower support or against a transporting conveyor as the workpiece is being fed horizontally into contact with the abrasive belt. In planing workpieces such as lumber, it is apparent that debris such as sawdust or chips are dislodged during abrading action. It is preferable to provide an exhaust duct or hood adjacent the area of contact of the abrasive belt with the lumber so that the debris may be immediately exhausted.

However, a problem arises in that prior art planing apparatus have not provided structure which adequately holds down the lumber while simultaneously exhausting debris. The problem arises from the fact that the lumber must be held down against a support closely adjacent to the point of lumber-belt contact. As a consequence, sufficient room for positioning an exhaust duct adjacent this point of contact simply has not been available. While hold down shoes have been located at a downstream position relative to the point of contact, such does not permit adequate holding down of the lumber adjacent its entry into contact with the abrasive belt.

Accordingly, it is a general object of the present invention to provide an abrading or planing apparatus in which a hold down shoe and exhaust duct are constructed as an integral assembly so that adequate holding down of the lumber and exhausting of debris can be simultaneously provided. More particularly, the present invention provides an assembly in which the hold-down shoe includes a member extending upwardly therefrom which forms a back wall of an entry duct.

Elaborating further, the entry duct includes an opening or mouth defined by a top wall member spaced apart from the hold down shoe. The top wall member is selectively positionable relative to the hold down shoe so that the cross-sectional area of the mouth may be selectively varied. As a result, the rate at which debris may be exhausted can correspondingly be varied.

Another object of the present invention is to provide an assembly, as described above, which may be readily mounted adjacent the frame of a planing apparatus and which includes biasing means operable for selectively pivoting the entry duct about a horizontal pivot axis. The axis extends generally transversely of the infeed direction of lumber conveyance and the biasing means includes a pair of cylinders having extendible-retractable rods.

These and additional objects and features of the present invention will be more readily understood from a consideration of the drawings and the detailed description of the preferred embodiment.

DETAILED DESCRIPTION OF THE PREFERRED EMBODIMENT

Figure 2:
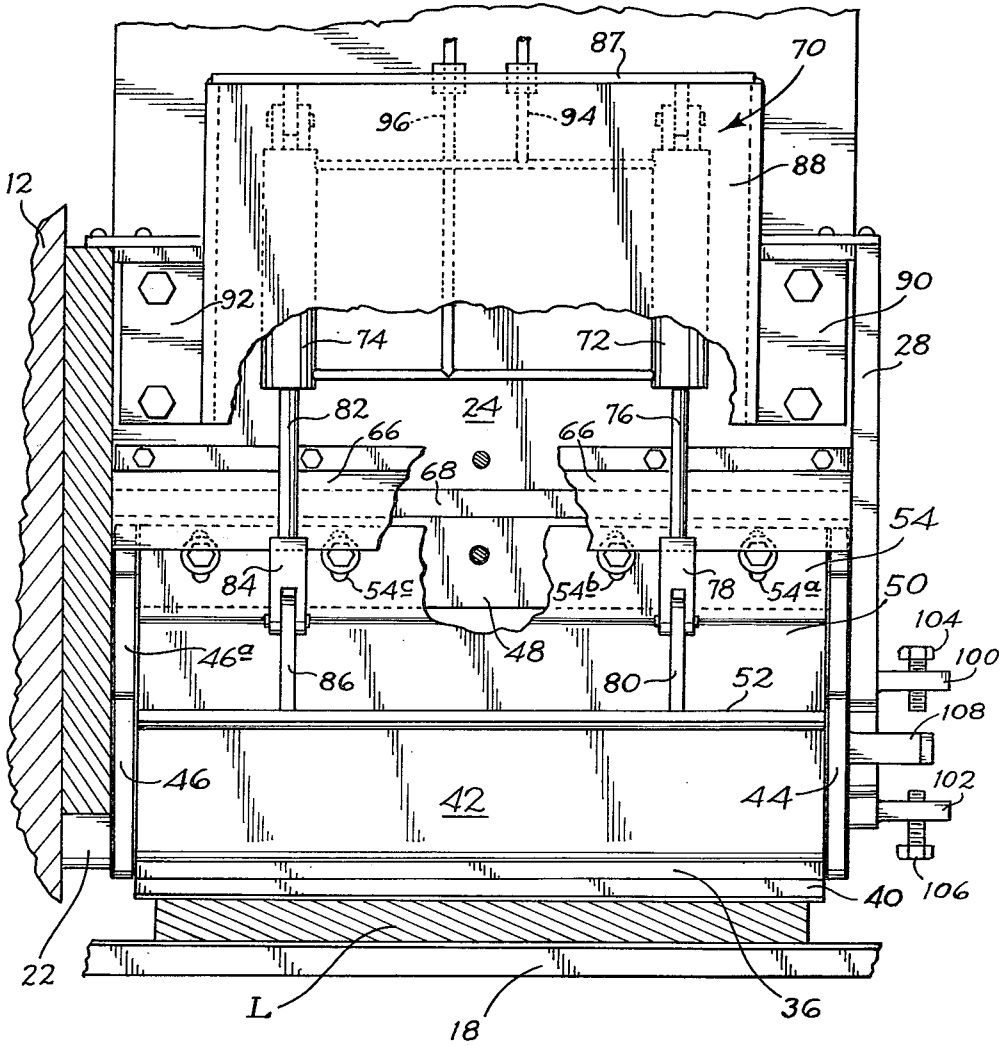
FIG. 2 is a front elevation view, with portions broken away, taken along lines 2—2 of FIG. 1.
Figure 1:
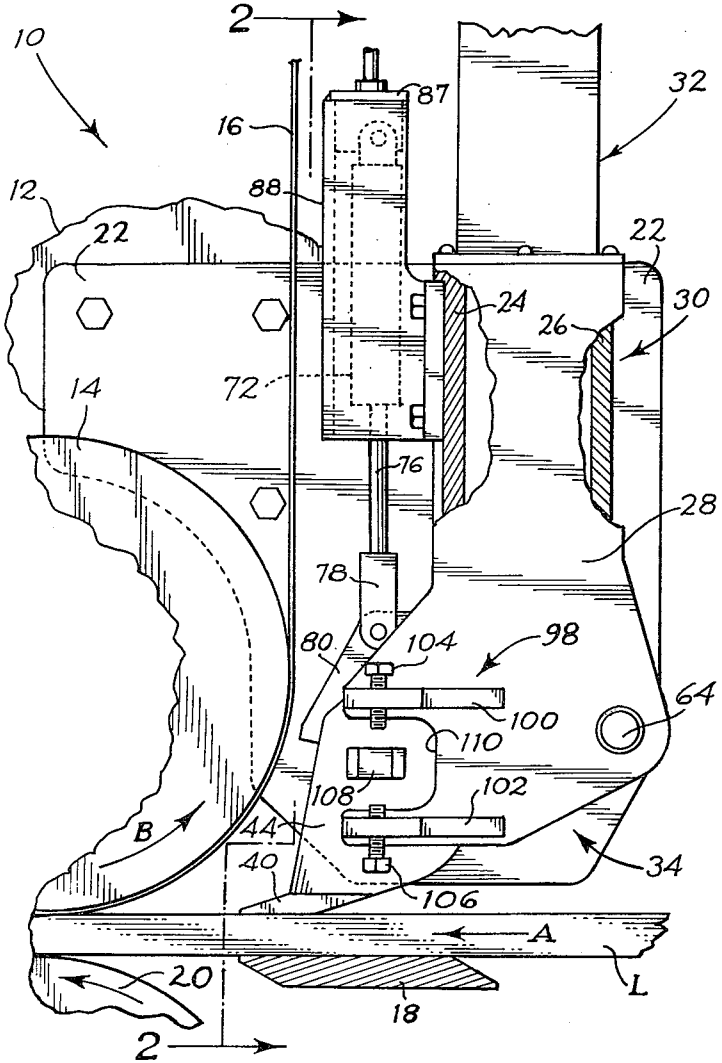
FIG. 1 is a side elevation view, with portions broken away, illustrating apparatus according to the present invention mounted adjacent to a conventional endless abrasive belt which is driven by a contact drum.

Turning now to the drawings, and referring initially to FIGS. 1 and 2, an abrading or planing apparatus according to the present invention is generally indicated at 10. It must be appreciated that only essential features of the present invention are illustrated, and therefore only a portion of a frame structure is indicated at 12. However, it should be understood that frame structure 12 may extend for a considerable length and include various suitable drive mechanisms.

A conventional contact drum 14 is only partially shown and is suitably journalled to frame 12 by known means. Drum 14 is operable for contacting an abrading means such as endless abrasive belt 16 which is suitably trained therearound and also around an upper drum or roller (not shown). The drum and abrasive belt are dimensioned with a width suitable for planing workpieces of predetermined widths. A fixed support means such as support plate 18 provides a horizontal surface over which a workpiece may be horizontally conveyed and supported for contact against abrasive belt 16. A lower support drum or roller is partially shown at 20.

Thus, it can be seen that a workpiece, such as lumber L, may be fed inwardly over support plate 18 and support roller 20 in the direction of arrow A so that its upper horizontal surface may be abraded or planed by continuous movement of abrasive belt 16 as drum 14 revolves counterclockwise in the direction of arrow B. As mentioned previously it is necessary to exhaust debris resulting from abrading action. Also, it is necessary that the lumber be held against support plate 18 so that even planing can occur.

Still referring to FIG. 1, it can be seen that a bracket 22 is suitably mounted to frame structure 12 behind drum 14 and abrasive belt 16. With reference also directed to FIG. 2, it can be seen that transversely extending members 24, 26 extend outwardly from bracket 22 and are secured thereto so as to span the width of belt 16. Members 24, 26 are interconnected by an outer plate 28 so that a so-called duct housing, generally indicated at 30, is provided. Extending upwardly from duct housing 30 is an upper duct generally indicated at 32. Upper duct 32 is appropriately secured to upper edge portions of bracket 12, members 24, 26 and plate 28 as shown.

Figures 3, 4, 5:
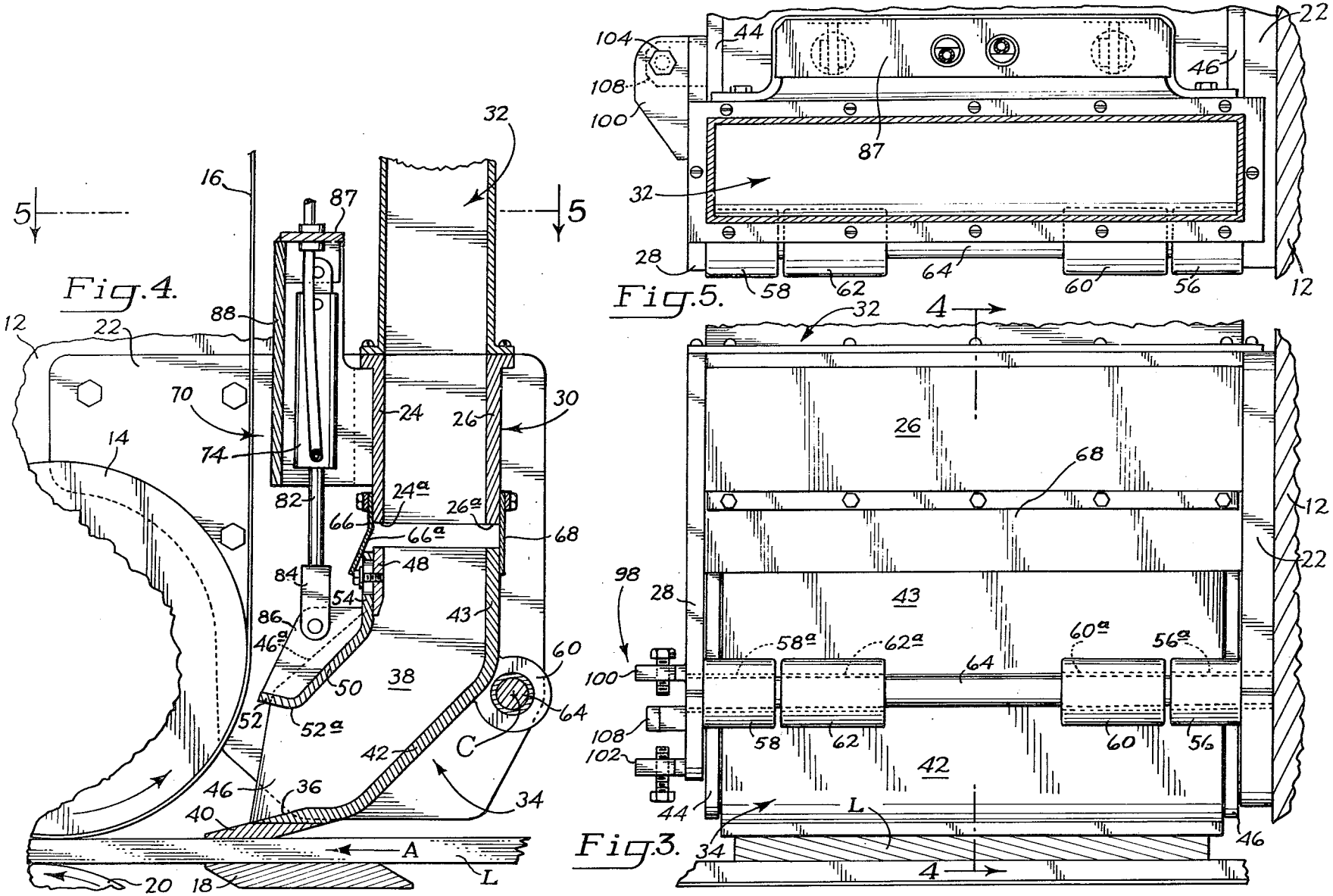
FIG. 3 is a rear elevation view of the apparatus shown in FIG. 1.
FIG. 4 is a side elevation view, shown in cross-section, taken along lines 4—4 of FIG. 3.
FIG. 5 is a top plan view of a portion of the apparatus illustrated in FIG. 1.

A principle feature of the present invention resides in the provision of an assembly which includes a combination pressure means operable for urging a workpiece against a support and an entry duct. Specifically, and turning to FIGS. 2, 3 and 4, it can be seen that an assembly, generally indicated at 34, includes a pressure means such as a hold-down shoe 36 forming part of an entry duct 38. Shoe 36 is provided with a polished toe piece 40 and diagonally upwardly extending member 42 and vertically extending member 43. Members 42, 43 define a rear wall of entry duct 38. While FIG. 4 is a cross-sectional view taken along lines 4—4 of FIG. 3, it can be seen from a consideration of FIG. 2 that entry duct 38 includes a pair of opposed side walls 44, 46. Side walls 44, 46 are secured at opposite ends of members 42, 43.

At an upper portion of entry duct 38 there is provided a front wall 48 which bridges and interconnects the side walls and is spaced apart from the rear wall as shown. Connected to front wall 48 is a top wall member 50 positioned with a portion generally paralleling member 42 and including lip 52 and a mounting portion 54. Lip 52 includes a curved interior surface 52*a*. Mounting portion 54 is provided with a plurality of extended openings or slots 54*a*, 54*b*, 54*c*, etc., so that appropriate bolts may be inserted therethrough and engaged with threaded apertures provided in front wall 48. The relative positioning of wall member 50 may be varied as desired by shifting the wall member vertically relative to front wall 48.

Further, it is to be noted that side walls 44, 46 have sloping upper edges such as shown at 46*a* on side wall 46. For instance, upper edge 46*a* slopes diagonally for connection to front wall 48 and is dimensioned so that slidable positioning of wall member 50 will never extend above upper edge 46*a*. Thus, it can be appreciated that entry duct 38 will provide a conduit having an opening or mouth defined between lip 52 and shoe 36. Because wall member 50 may be selectively positioned, the cross-sectional area of the mouth may also be varied.

As shown in FIG. 3, it can be seen that opposed cylindrical sleeves 56, 58 are mounted on bracket 22 and plate 28, respectively. Sleeves 56, 58 are provided with aligned bores 56*a*, 58*a*, respectively. Further, opposed cylindrical sleeves 60, 62 are mounted on the rear wall of entry duct 38 and are provided with aligned bores 60*a*, 62*a*, respectively. A pivot or hinge pin 64 extends through sleeves 56, 58, 60 and 62 as well as through aligned bores provided in bracket 22 and plate 28. Thus, it can be appreciated that assembly 34 includes entry duct 38 is pivotal for swinging movement about a pivot axis C defined by the longitudinal axis of hinge pin 64. Shoe 36 and toe piece 40 may thereby be urged against the work piece.

Turning again to FIG. 4, it can be appreciated that the top of entry duct 38 is positioned somewhat below the bottom edges 24*a*, 26*a* of wall members 24, 26, respectively so that pivotal movements of the entry duct (including wall member 50) about pivot axis C will not be impeded. However, in order to provide an adequate seal between the ducts, flexible members 66, 68 extend between bracket 22 and plate 28 as shown in FIGS. 2 and 4. Flexible member 66 includes a flap portion 66*a* which extends over mounting portion 54 of wall member 50. Accordingly, it can be appreciated that upon pivotal movement of assembly 34 about pivot axis C, flexible members 66, 68 will ensure that a closed passage exists between entry duct 38 and the duct provided in housing 30.

As mentioned previously, it is a particular advantage of the present invention that assembly 34 includes both a hold-down shoe and an entry duct integrally formed therewith. In order to urge shoe 36 and toe piece 40 onto a work-piece so that the workpiece is maintained against support plate 18, a biasing means, generally indicated at 70, is provided. Biasing means 70 includes extendible-retractable means such as fluid actuated cylinders 72, 74 operable for selectively pivoting or swinging assembly 34 about pivot axis C. Each of the cylinders 72, 74 is provided with an associated extendible-retractable rod such as rod 76, 78, respectively.

Each of the rods is provided with a connecting clevis which is suitably connected to a link provided on wall member 50. For instance, rod 76 includes a clevis 78 suitably connected by a pin to a link 80. Similarly, cylinder 74 includes a rod 82 having a clevis 84 suitably pin-connected to a link 86. Cylinders 72, 74 are suitably connected at their upper ends to a mounting plate 87. Plate 87 is mounted on top of a cover plate 88 which includes flanged portions 90, 92. In turn, the flanged portions are secured, as by bolts, to member 24 of housing 30.

Fluid introducing conduits 94, 96 are connected in known manner by tee branches to each of the cylinders for providing actuating power. The conduits are connected to an appropriate source of fluid control (not shown). Thus, it can be appreciated that biasing means 70 is selectively operable for swinging assembly 34 about pivot axis C so that shoe 36 and toe piece 40 may be urged against a work piece.

A problem sometimes arises in that lumber having thicknesses beyond a predetermined range or surface projections may be inadvertently fed toward belt 16. The present invention prevents the lumber from ramming against the belt by providing a limit means for limiting pivotal movement of assembly 34. By so limiting pivotal movement, shoe 36 will serve to impede forward travel of the lumber. Specifically, plate 28 is provided with a limit means, generally indicated at 98, which includes a pair of opposed lugs 100, 102. The lugs extend laterally from plate 28 (see FIG. 5 as well as FIGS. 1 and 2) and are provided with adjustable means such as bolts 104, 106, respectively. The bolts are threadedly engaged in suitably provided bores. Extending laterally from side wall 44 is an element 108 which extends outwardly through a throat 110 provided adjacent a forward portion of plate 28. Depending upon the relative positioning of bolts 104, 106, element 108 will contact the bolts after a predetermined amount of angular movement of assembly 34 has occurred.

For instance, it can be seen from a consideration of FIGS. 1 and 2 that a work piece having a thickness somewhat greater than that illustrated would not be permitted to pass beneath toe piece 40 because the top of element 108 would contact bolt 104 projecting through lug 100 thereby limiting pivotal movement of assembly 34 in the upward direction.

From the above description, it can be appreciated that the present invention provides several important advantages. For instance, assembly 34 mounted within housing 30 provides an integral combination of an entry duct of an exhaust duct means combined witha hold-down shoe. Workpieces may thereby be accurately held with a during in-feed to abrasive belt 16 while debris will correspondingly be immediately exhausted from adjacent a point of belt-workpiece contact.

Additionally, the construction of assembly 34 is relatively simple in that shoe 36 is formed with members 42, 43 which define a back or rear wall of entry duct 38. Further, by pivotally connecting assembly 34 to bracket 22, shoe 36 and toe piece 40 may be selectively urged by biasing means 70 to any preselected amount of pressure against a workpiece.

Another feature of importance is the construction of wall member 50 which is adjustably connected to front wall 48 in assembly 34. Assuming a set orientation of shoe 36 and toe piece 40, it can be seen that wall member 50 may be selectively positioned along front wall 48 by first loosening the retaining bolts and shifting the wall member vertically upwardly or downwardly between side walls 44, 46. (This is assuming a release of pressure from biasing means 70). By so positioning wall member 50, it can be appreciated that the mouth of entry duct 38 may have its cross-sectional area selectively varied to increase or decrease the flow rate of exhaust air into the duct and thus the rate of debris suction through housing 30 and duct 32.

Furthermore, it should be appreciated that curved interior surface 52*a* joining wall member 50 with lip 52 provides a surface conducive to air and debris flow upwardly through entry duct 38. Depending upon the particular physical characteristics of a workpiece, it has been found necessary to adjust wall member 50 in order to provide a desired rate of debris exhaust.

Considering biasing means 70 in further detail, it can be appreciated that cylinders 72, 74 are operable for selectively swinging assembly 34 about pivot axis C. It can therefore be appreciated that a predetermined amount of pressure against a workpiece may be selectively provided. Furthermore, the location of biasing means 70 on a forward portion of housing 30 offers several advantages. First of all, it can be seen that actuating cylinders 72, 74 may be readily coupled with assembly 34 so that selective pivotal movement may be provided. Additionally, assembly 34 and biasing means 70 are disposed adjacent to each other and provide ready access in times of maintenance or repair.

While the invention has been particularly shown and described with reference to the foregoing preferred embodiment, it will be understood by those skilled in the art that other changes in form and detail may be made therein without departing from the spirit and scope of the invention as defined in the appended claims.

It is claimed and desired to secure by Letters Patent:

1. In apparatus for abrading a workpiece including a frame, workpiece support means and an abrading means mounted above said support means, an assembly comprising:

pressure means mounted on said frame selectively operable for urging the workpiece against said support means as the workpiece is being fed into contact with said abrading means including a hold-down shoe extending transversely of the workpiece relative to its infeed direction of travel, said hold-down shoe including an upwardly extending member;

duct means including an entry duct movable with said pressure means for exhausting debris from the workpiece during abrading action, said upwardly extending member defining a rear wall of said entry duct, said entry duct also including a top wall member; and biasing means connected to said said top wall member of said entry duct selectively operable for pivoting said entry duct and said pressure means about a common axis so that said hold-down shoe may be urged against the workpiece.

2. The apparatus of claim 1 wherein said top wall member is selectively positionable relative to said hold down shoe so that the cross-sectional area of opening between said hold down shoe and said top wall member may be selectively varied.

3. The apparatus of claim 2 wherein a bracket is secured to said frame and includes members extending therefrom which define a housing, said entry duct being mounted within said housing.

4. The apparatus of claim 3 wherein said entry duct is pivotally connected to said bracket for pivotal movement about a pivot axis extending transversely of the workpiece relative to its infeed direction of travel.

5. The apparatus of claim 4 wherein said biasing means includes extendible-retractable means connected to said top wall member.

6. The apparatus of claim 3 wherein limit means are provided on said housing for limiting pivotal movement of said entry duct.

7. The apparatus of claim 6 wherein said limit means is selectively adjustable.

8. The apparatus of claim 7 wherein said entry duct includes an element extending laterally therefrom which engages said limit means at preselected upper and lower limits of entry duct pivotal movement.

* * * * *